US008312795B2

(12) United States Patent
Richardson

(10) Patent No.: US 8,312,795 B2
(45) **Date of Patent: *Nov. 20, 2012**

(54) MULTIPLE-LINK TOOL ASSEMBLY, TOOL EXTENSION, AND METHOD

(75) Inventor: Michael D. Richardson, Charlotte, NC (US)

(73) Assignee: Richardson-Hynes, LLC, Tega Cay, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/423,732

(22) Filed: Mar. 19, 2012

(65) Prior Publication Data

US 2012/0174717 A1 Jul. 12, 2012

Related U.S. Application Data

(63) Continuation of application No. 12/583,296, filed on Aug. 18, 2009, now Pat. No. 8,141,462, which is a continuation-in-part of application No. 11/825,775, filed on Jul. 9, 2007, now abandoned.

(51) Int. Cl.
*B25B 23/16* (2006.01)
*B25G 3/38* (2006.01)

(52) U.S. Cl. ..... 81/177.2; 81/177.8

(58) Field of Classification Search ..... 81/177.2, 81/177.8, 177.9, 180.1
See application file for complete search history.

(56) References Cited

U.S. PATENT DOCUMENTS

| | | | | |
|---|---|---|---|---|
| 2,603,325 | A * | 7/1952 | Pickard | 403/1 |
| 2,671,367 | A * | 3/1954 | Modin | 81/58.3 |
| 3,039,339 | A | 6/1962 | Hanson | |
| 3,996,821 | A * | 12/1976 | Murray | 81/177.2 |
| 5,230,263 | A | 7/1993 | Kwaka | |
| 6,000,299 | A * | 12/1999 | Cole | 81/60 |
| 6,089,128 | A | 7/2000 | Kopyless | |
| 6,234,051 | B1 | 5/2001 | Bareggi | |
| 6,643,877 | B1 * | 11/2003 | Amtenbrink et al. | 7/125 |
| 6,928,903 | B1 * | 8/2005 | Liao | 81/58.3 |
| 7,299,723 | B1 * | 11/2007 | Wessel, IV | 81/177.2 |
| 8,141,462 | B2 * | 3/2012 | Richardson | 81/177.2 |
| 2006/0137491 | A1 * | 6/2006 | Chen | 81/58 |

* cited by examiner

*Primary Examiner* — David B Thomas
(74) *Attorney, Agent, or Firm* — Schwartz Law Firm, P.C.

(57) ABSTRACT

A multiple-link tool assembly includes an elongated handle, an exchangeable extension link, and an exchangeable tool link. The exchangeable extension link has a first connecting end removably linked to the handle, and a second connecting end defining a sectioned cavity. The sectioned cavity includes a reduced-diameter internally serrated cavity section and an enlarged-diameter non-serrated cavity section. An adjustable geometric fitting having an externally serrated base is received and retained within the sectioned cavity. A spring is located within the non-serrated cavity section, and is adapted for normally urging the externally serrated base of the geometric fitting into the internally serrated cavity section. The exchangeable tool link has a proximal end removably joined to the geometric fitting of the extension link, and a fastener-engaging distal end adapted for engaging a threaded fastener.

20 Claims, 14 Drawing Sheets

MULTIPLE-LINK TOOL ASSEMBLY, TOOL EXTENSION, AND METHOD

TECHNICAL FIELD AND BACKGROUND

The invention in its exemplary embodiments described herein relates broadly to a multiple-link tool assembly, tool extension, and method.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification.

It is an object of one or more exemplary embodiments described herein to provide a multiple-link tool assembly capable of extending along a variety of angles in order to reach a fastener which would otherwise be substantially inaccessible using conventional tools. The invention may be assembled in infinitely-variable combinations, and may extend in an interconnected series of relatively soft angles or actuate lengths.

It is another object of one or more exemplary embodiments described herein to provide a method for accessing and operatively engaging a fastener which would otherwise be substantially inaccessible using conventional tools.

It is yet another object of one or more exemplary embodiments described herein to provide a custom-arranged tool extension for use in a multiple-link tool assembly.

These and other objects of the present invention are achieved in the exemplary embodiments disclosed below by providing a multiple-link tool assembly including an elongated handle, at least one exchangeable extension link, and an exchangeable tool link. The handle comprises a portion adapted for being gripped by a user. The exchangeable extension link comprises first and second connecting ends, and an angled body intermediate the first and second connecting ends. The first connecting end is removably connected to the handle. The exchangeable tool link has a proximal end removably connected to the second end of the extension link and a fastener-engaging distal end adapted for engaging a threaded fastener.

According to another exemplary embodiment, the second connecting end of the extension link and the proximal end of the tool link are coaxially arranged. The term "coaxially arranged" means that the connecting ends of adjacent links extend along substantially the same longitudinal axis when the links are assembled together.

According to another exemplary embodiment, the angled body of the extension link defines a radiused bend at an angle selected from a group including substantially 90 degrees, substantially 45 degrees, and substantially 15 degrees.

According to another exemplary embodiment, the bend defined by the angled body has a radius between 0.3 and 0.5 inches.

According to another exemplary embodiment, the first and second connecting ends of the extension link comprise respective male and female connectors integrally formed with the body.

According to another exemplary embodiment, the male connector comprises a multi-walled insert.

According to another exemplary embodiment, the proximal end of the tool link comprises a boxed socket complementary to the multi-walled insert of the extension link, and receiving the multi-walled insert at a selected one of a plurality of available tool orientations. Each tool orientation locates the fastener-engaging end of the tool link at a distinct orientation relative to the handle.

According to another exemplary embodiment, the fastener-engaging distal end of the tool link comprises a wrench.

According to another exemplary embodiment, the first and second connecting ends of the extension link comprise respective multi-walled connectors integrally formed with the body.

According to another exemplary embodiment, the proximal end of the tool link comprises a multi-walled connector complementary to the second end of the extension link, and engaging the second end of the extension link at a selected one of a plurality of available tool orientations. Each tool orientation locates the wrench at a distinct notional plane of engagement.

In another exemplary embodiment, the invention comprises a multiple-link tool assembly including an elongated handle, a custom-configurable tool extension, and an exchangeable tool link. The handle includes a portion adapted for being gripped by a user. The custom-configurable tool extension is removably connected to the handle and comprises a plurality of exchangeable and interconnected extension links. Each extension link has first and second connecting ends, and an angled body intermediate the first and second connecting ends. An exchangeable tool link has a proximal end removably connected to the tool extension, and a fastener-engaging distal end adapted for engaging a threaded fastener.

In yet another exemplary embodiment, the invention comprises a method for accessing and operatively engaging a threaded fastener. The method includes connecting a first angled extension link to an elongated handle of a multiple-link tool assembly. A second angled extension link is then connected to the first angled extension link, such that the first and second extension links form a custom-configurable tool extension. An exchangeable tool link is then connected to the tool extension. The tool link has a fastener-engaging distal end. The fastener-engaging distal end of the tool link is then positioned onto the threaded fastener.

According to another exemplary embodiment, the method includes connecting a third angled extension link to the second angled extension link, such that the first, second, and third extension links form a custom-configurable tool extension.

According to another exemplary embodiment, the method includes arranging the fastener-engaging distal end of the tool link at a selected one of a plurality of available tool orientations.

In yet another exemplary embodiment, the disclosure comprises a multiple-link tool assembly including an elongated handle, an exchangeable extension link, and an exchangeable tool link. The handle has a portion adapted for being gripped by a user. The exchangeable extension link comprises first and second connecting ends. The first connecting end is removably linked to the handle, and the second connecting end defines a sectioned cavity. The sectioned cavity includes a reduced-diameter internally serrated cavity section and an enlarged-diameter non-serrated cavity section. An adjustable geometric fitting having an externally serrated base is received and retained within the sectioned cavity. A spring is located within the non-serrated cavity section, and is adapted for normally urging the externally serrated base of the geometric fitting into the internally serrated cavity section. The complementary serrations of the geometric fitting and the sectioned cavity engage to operatively lock the geometric fitting in a selected orientation relative to the handle. Upon linear movement of the geometric fitting against a biasing force of the spring, the complementary serrations of the externally serrated base and the internally serrated cavity section disengage as the externally serrated base moves into the non-serrated cavity section, thereby enabling rotational adjustment of the geometric fitting to another selected orientation relative to the handle. The exchangeable tool link has a proximal end removably joined to the geometric fitting of the extension link, and a fastener-engaging distal end adapted for engaging a threaded fastener. Each selected orientation of the geometric fitting locates the fastener-engaging distal end of the tool link at a distinct notional plane of engagement relative to the threaded fastener.

According to another exemplary embodiment, the extension link comprises a body portion intermediate the first and second connecting ends, and formed at an angle selected from a group consisting of substantially 90 degrees, substantially 45 degrees, and substantially 15 degrees.

According to another exemplary embodiment, the geometric fitting comprises a solid square head formed with the externally serrated base.

According to another exemplary embodiment, the proximal end of the tool link comprises a boxed socket complementary to the geometric fitting of the extension link.

According to another exemplary embodiment, the fastener-engaging distal end of the tool link comprises a wrench.

In still another exemplary embodiment, the disclosure comprises a multiple-link tool assembly including an elongated handle and an exchangeable tool link. The handle has a portion adapted for being gripped by a user. The exchangeable tool link comprises a fastener-engaging distal end adapted for engaging a threaded fastener, and an opposing proximal end removably linked to the handle. The proximal end defines a sectioned cavity comprising a reduced-diameter internally serrated cavity section and an enlarged-diameter non-serrated cavity section. An adjustable geometric fitting has an externally serrated base which is received and retained within the sectioned cavity. A spring is located within the non-serrated cavity section, and is adapted for normally urging the externally serrated base of the geometric fitting into the internally serrated cavity section. Complementary serrations of the geometric fitting and the sectioned cavity engage to operatively lock the geometric fitting in a selected orientation relative to the fastener-engaging distal end. Upon linear movement of the geometric fitting against a biasing force of the spring, the complementary serrations of the externally serrated base and the internally serrated cavity section disengage as the externally serrated base moves into the non-serrated cavity section, thereby enabling rotational adjustment of the geometric fitting to another selected orientation relative to the fastener-engaging distal end.

According to another exemplary embodiment, the tool link comprises a body portion intermediate the distal and proximal ends, and formed at an angle selected from a group consisting of substantially 90 degrees, substantially 45 degrees, and substantially 15 degrees.

According to another exemplary embodiment, the handle comprises a connecting end defining a boxed socket complementary to the geometric fitting of the tool link.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at lease one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterite) is not intended to indicate or imply that the invention has been previously reduced to practice or that any testing has been performed.

Figure 1:
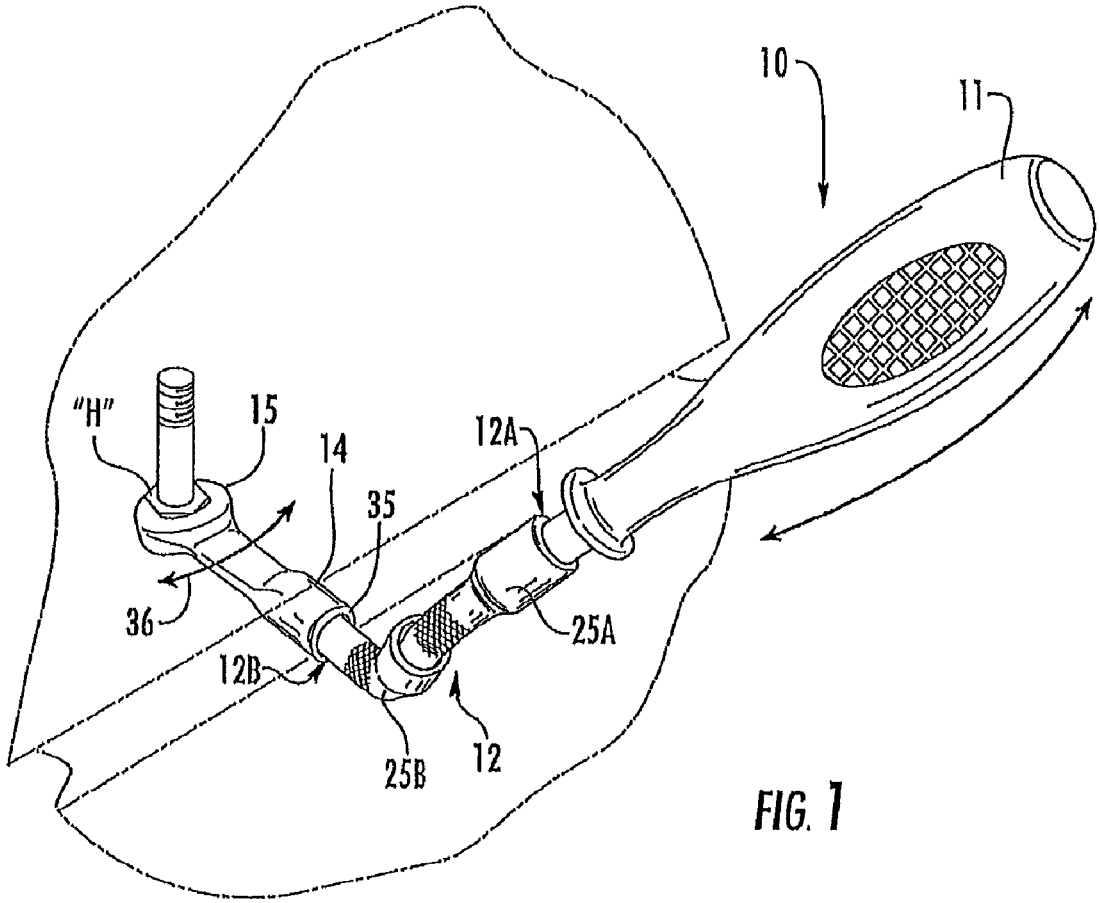
FIG. 1 is an environmental perspective view of a multi-link tool assembly according to one exemplary embodiment of the present invention.
Figure 2:
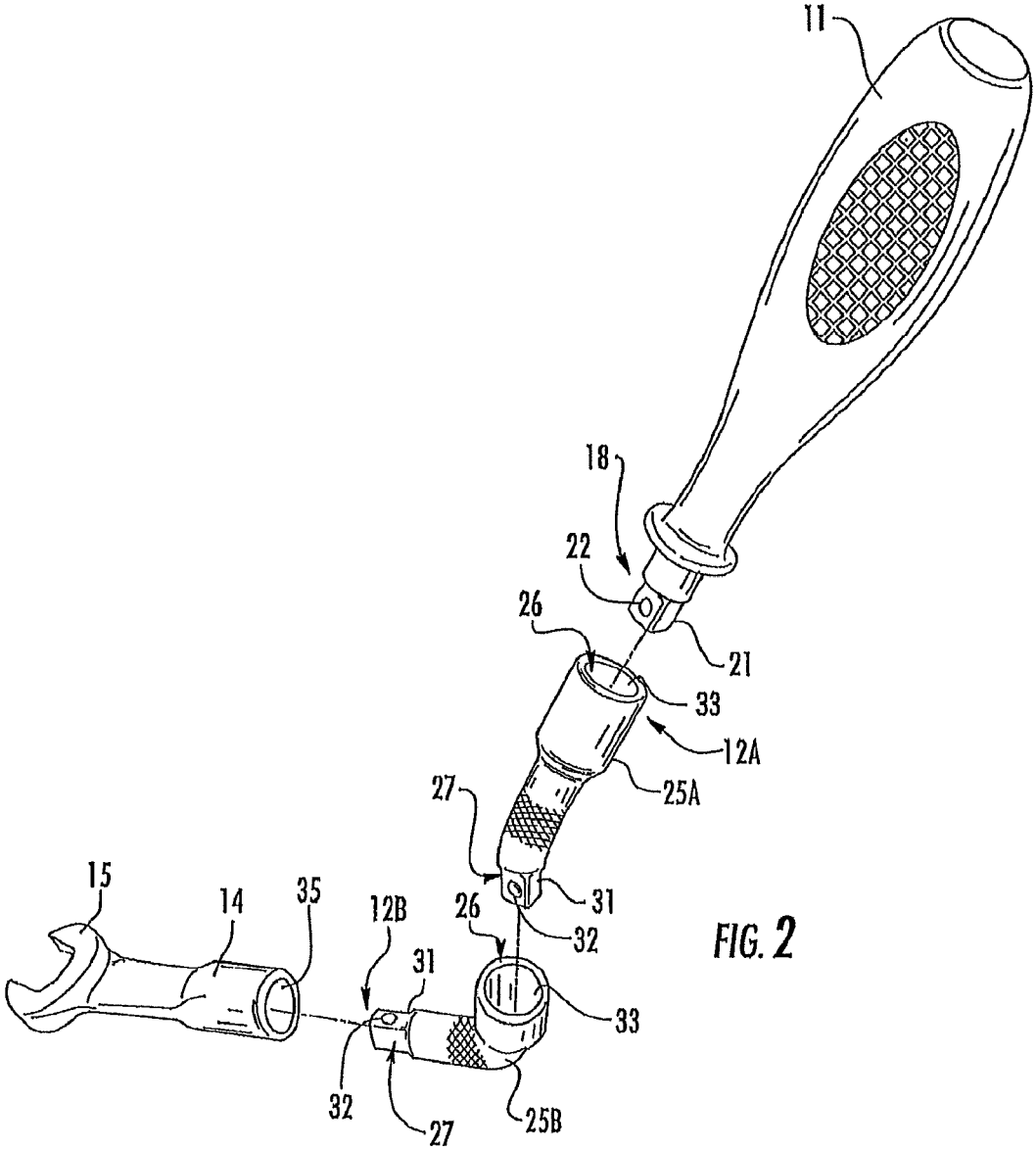
FIG. 2 is an exploded perspective view of the multi-link tool assembly.
Figure 3:
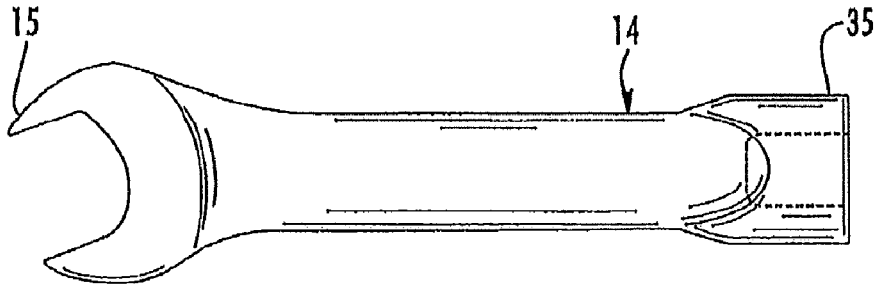
FIGS. 3 and 4 are respective top and side views of one exemplary tool link.
Figure 4:
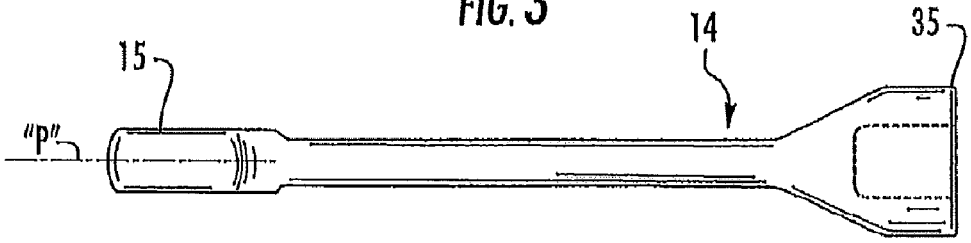
Figure 5:
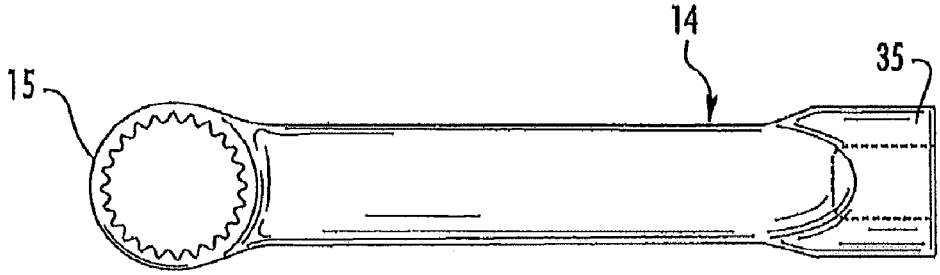
FIGS. 5 and 6 are respective top and side views of a second exemplary tool link.
Figure 6:
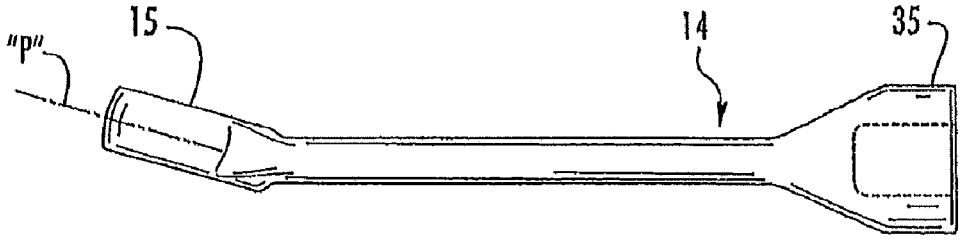

Referring now specifically to the drawings, a multiple-link tool assembly according to one exemplary embodiment of the present invention is illustrated in FIG. 1 and shown generally at reference numeral 10. In the embodiment of FIGS. 1 and 2, the tool assembly 10 comprises a handle 11, a custom-configurable tool extension 12 connected to the handle 11, and an exchangeable tool link 14 connected to the extension 12. The tool link 14 has a fastener-engaging end 15 comprising, for example, an open-end wrench, as shown in FIGS. 3 and 4, or a box-end wrench, as shown in FIGS. 5 and 6. Other common tool ends including (but not limited to) socket wrenches, ratcheting box-end wrenches, flat head screw drivers, Phillips head screw drivers, and the like are also contemplated herein.

The handle 11 has a textured grip portion, and a proximal connecting end 18 shown in FIG. 2. The connecting end 18 comprises a square-shaped fitting 21 or other multi-walled male insert (or "drive"), opposing ball detents 22, and an internal spring (not shown). The square fitting 21 may be, for example, a common ¼ inch, ⅜ inch, ½ inch, or ¾ inch drive. For tool links 14 comprising flat or Phillips head screw drivers, the handle 11 may also incorporate an internal ratcheting mechanism.

As shown in FIGS. 1 and 2, the tool extension 12 comprises one or more exchangeable extension links 25A, 25B. Each extension link 25A, 25B has first and second connecting ends 26, 27, and an arcuate textured body 28 intermediate the first and second connecting ends. The connecting ends 26, 27 may form respective male and female connectors; the male connector comprising a square fitting 31 with opposing spring-loaded ball detents 32, and the female connector comprising a complementary square socket 33. In the implementation shown, the tool extension 12 is assembled by mating the square fitting 31 and socket 33 of the adjacent extension links 25A, 25B. Of course, any number of extension links may be readily assembled in a like manner to custom-configure the tool extension 12 to serve any particular need or maneuver any given obstacle.

Once assembled as desired, a proximal end 12A of the extension link 12 (defining a socket in this case) is releasably mated with the square fitting 21 of the handle 11. Construction of the multi-link tool assembly 10 is then completed by connecting a proximal socket end 35 of the tool link 14 to the distal end 12B of the tool extension 12. The fastener-engaging end 15 of the tool link 14 defines a notional plane of engagement "P" (See FIGS. 4 and 6) which aligns with the head "H" of the fastener (or nut), as shown in FIG. 1, to operatively engage the fastener for rotation as indicated at arrow 36.

Figure 7:
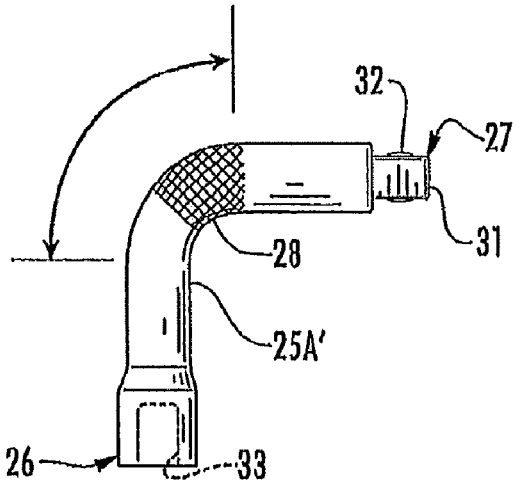
FIGS. 7, 8, and 9 are side views of exemplary extension links.
Figure 8:
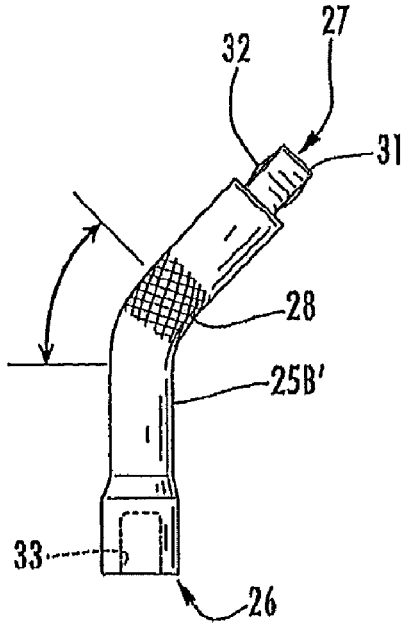
Figure 9:
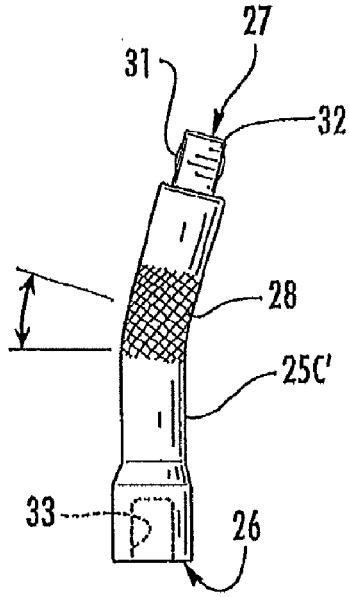
Figure 10:
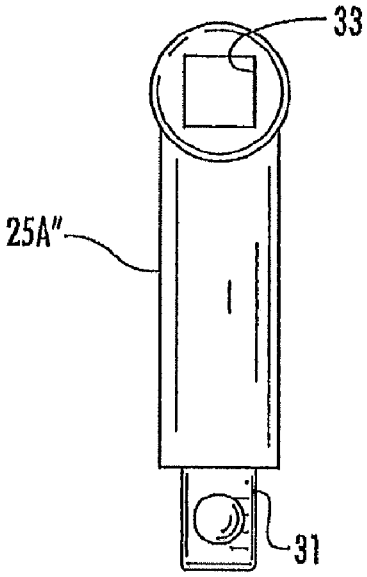
FIGS. 10, 11, 12, and 13 are end views of exemplary extension links.
Figure 11:
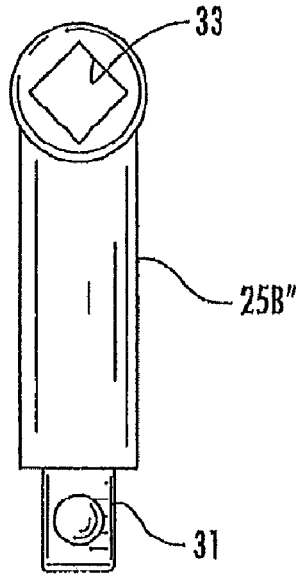
Figure 12:
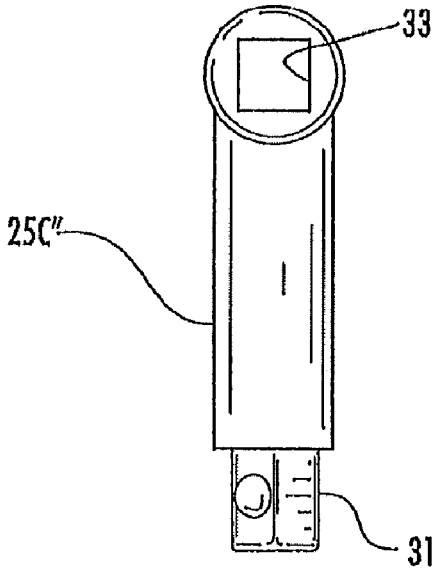
Figure 13:
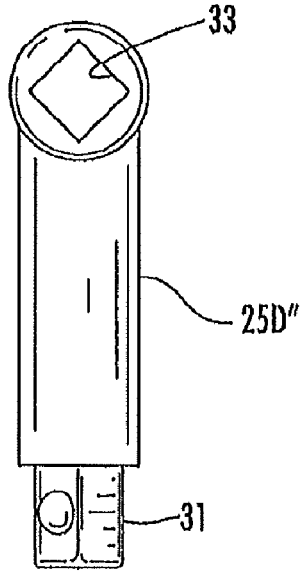
Figure 14:
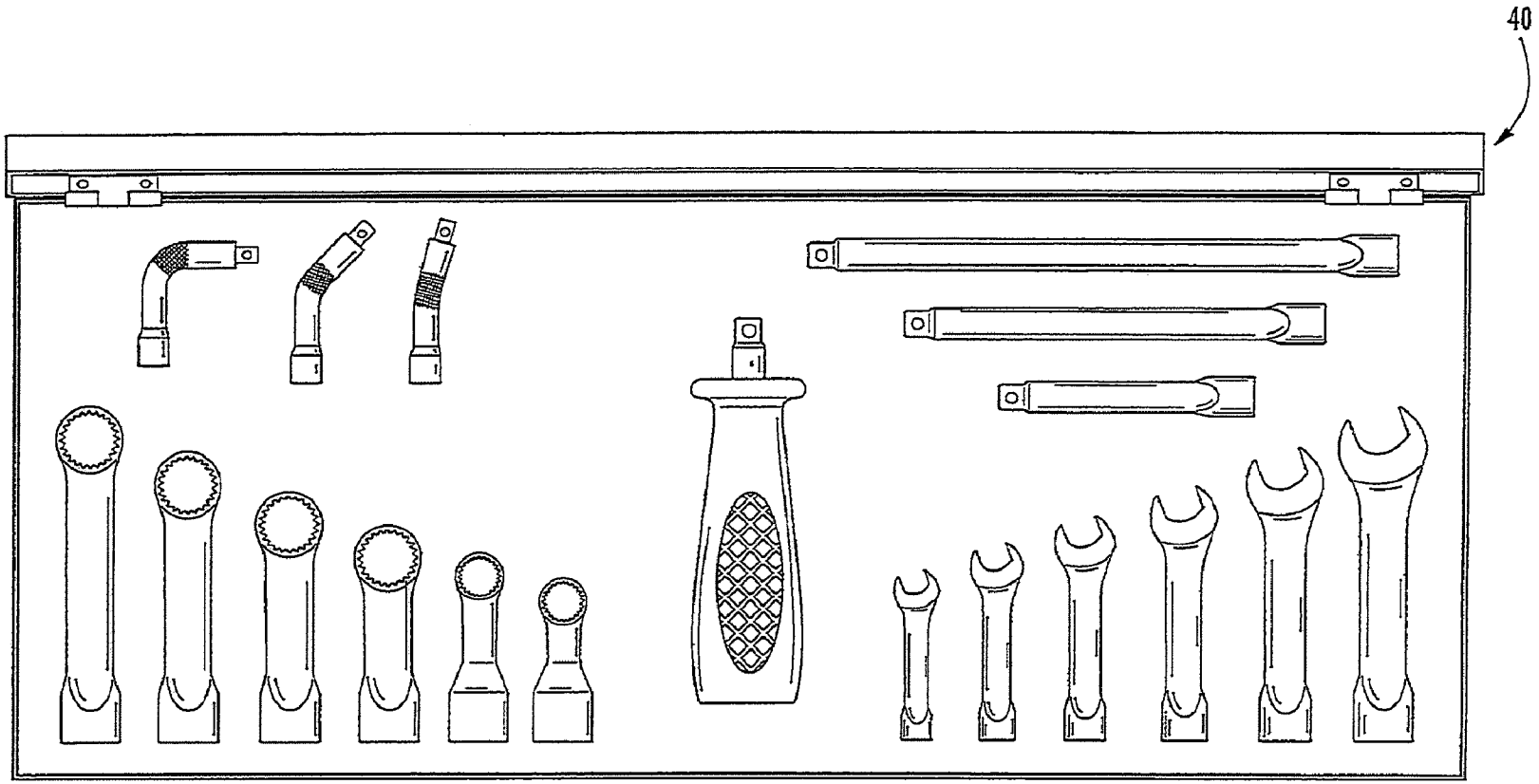
FIG. 14 is a view of a tool case with its top open to demonstrate storage of various components of the multiple-link tool assembly.

FIGS. 7, 8, and 9 show various exemplary embodiments of extension links 25A', 25B', and 25C'. The extension link 25A' of FIG. 7 has first and second connecting ends 26, 27, and an arcuate textured body 28 intermediate the first and second connecting ends, as previously described. The connecting ends form respective male and female connectors; the male connector comprising a square fitting 31 with opposing spring-loaded ball detents 32, and the female connector comprising a complementary square socket 33. The arcuate body of the link defines an angle of approximately 90 degrees with a bend radius of between 0.3 and 0.5 inches.

The extension link 25B' of FIG. 8 has first and second connecting ends 26, 27, and an arcuate textured body 28 intermediate the first and second connecting ends, as previously described. The connecting ends form respective male and female connectors; the male connector comprising a square fitting 31 with opposing spring-loaded ball detents 32, and the female connector comprising a complementary square socket 33. The arcuate body of the link defines an angle of approximately 45 degrees with a bend radius of between 0.3 and 0.5 inches.

The extension link 25C' of FIG. 9 has first and second connecting ends 26, 27, and an arcuate textured body 28 intermediate the first and second connecting ends. The connecting ends form respective male and female connectors; the male connector comprising a square fitting 31 with opposing spring-loaded ball detents 32, and the female connector comprising a complementary square socket 33. The arcuate body of the link defines an angle of approximately 15 degrees with a bend radius of between 0.3 and 0.5 inches.

Referring to FIGS. 10-13, for added customization certain extension links 25A", 24B", 25C", and 25D" may have square fittings 31 and/or sockets 33 which are formed at different orientations. For example, the extension links 25A" & 25C" and 25B" & 25D" shown in FIGS. 10 & 12 and FIGS. 11 & 13, respectively, are otherwise identical except for the different orientation of the square fittings 31 (compare FIGS. 10 & 12 and FIGS. 11 & 13). Additionally, in an alternative implementation, the square fitting and/or socket may be rotatably adjusted or indexed between multiple, releasably-lockable positions. The different orientations of the sockets and/or fittings allow added unique configurations of the tool extension, and further options for locating the notional plane of engagement defined by the fastener-engaging end of the tool link.

For convenience transport and storage, the various components of multi-link tool assembly 10 may be housed in single tool case 40. The tool case 40 may define recessed beds for each of the different components, including the handle, angled extension links, straight extensions links, and tool links.

Additional Embodiments of Tool Assembly, Extension Link, Tool Link, and Handle

Figure 15:
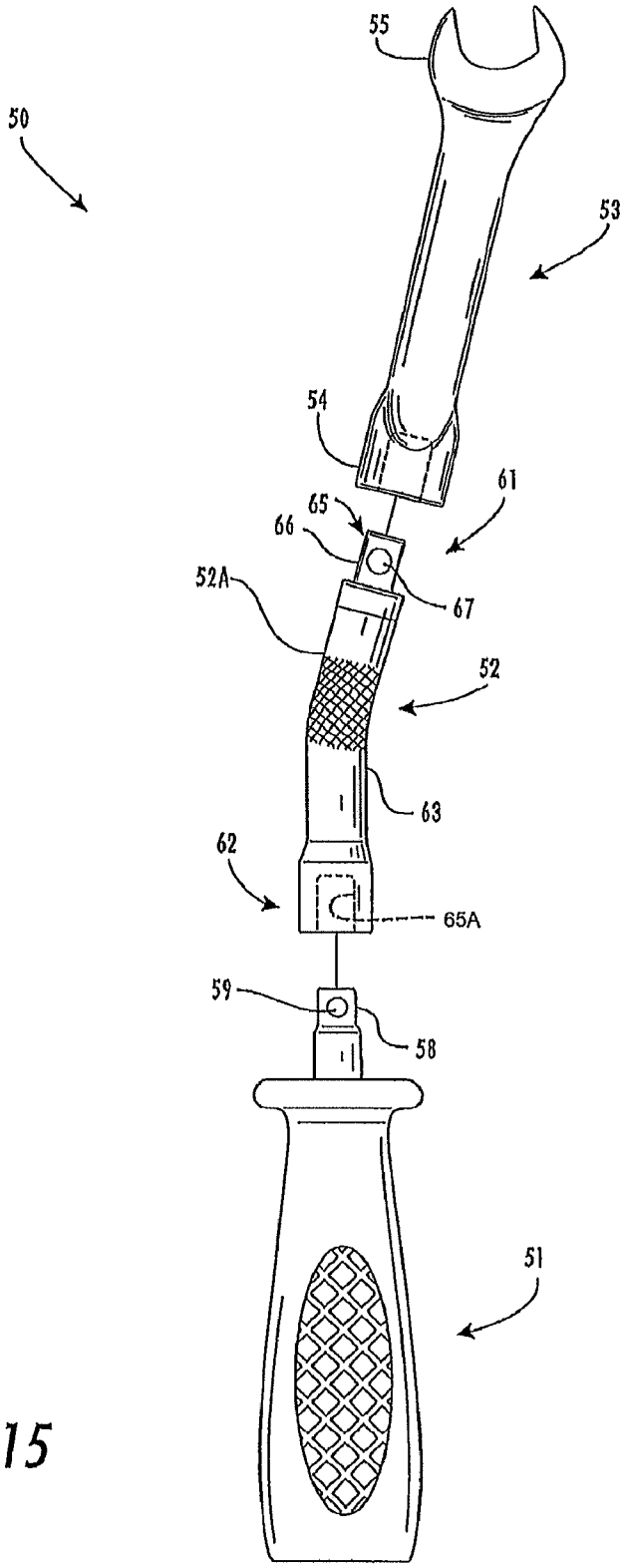
FIG. 15 is an exploded view of a multiple-link tool assembly according to another exemplary embodiment of the present disclosure.

Further exemplary embodiments of the present disclosure are illustrated in FIGS. 15-24. Referring to FIG. 15, the exemplary tool assembly 50 comprises a handle 51, a custom-assembled tool extension 52 connected to the handle 51, and an exchangeable tool link 53 connected to the extension 52. The exchangeable tool link 53 has a socket end 54 and a fastener-engaging end 55 comprising, for example, an open-end wrench. As stated previously, other common tool ends including (but not limited to) socket wrenches, ratcheting box-end wrenches, flat head screw drivers, Phillips head screw drivers, and the like are also contemplated in this exemplary embodiment.

The tool handle 51 has a textured grip portion, and a connecting end comprising a square-shaped fitting 58 or other multi-walled male insert (or "drive") with one or more spring-loaded ball detents 59. The square fitting 58 may be, for example, a common ¼ inch, ⅜ inch, ½ inch, or ¾ inch drive. For tool links comprising flat or Phillips head screw drivers, the handle may also incorporate an internal ratcheting mechanism.

The custom-assembled tool extension 52 may comprise a single extension link 52A, as shown, or multiple links which may be custom assembled (as demonstrated in FIGS. 1 and 2). The extension link 52A has first and second connecting ends 61 and 62, and a textured body 63 intermediate the connecting ends 61, 62. The body 63 may be substantially straight, or formed at various angles including (e.g) substantially 15 degrees, as in FIG. 15, or substantially 90 degrees in the extension link 52B shown in FIG. 20, or substantially 45 degrees in the extension link 52C shown in FIG. 21. These extension links 52A, 52B, 52C and others may be custom-assembled by the user in any desired configuration, as previously discussed. The connecting ends may 61, 62 include respective male and female connectors; the male connector comprising an adjustable geometric fitting 65, described below, and the female connector defining a substantially square socket 65A. The square socket 65A of the extension link 52A may be releasably mated with the square fitting 58 of the tool handle 51 to interconnect the extension link 52A and handle 51.

Figure 16:
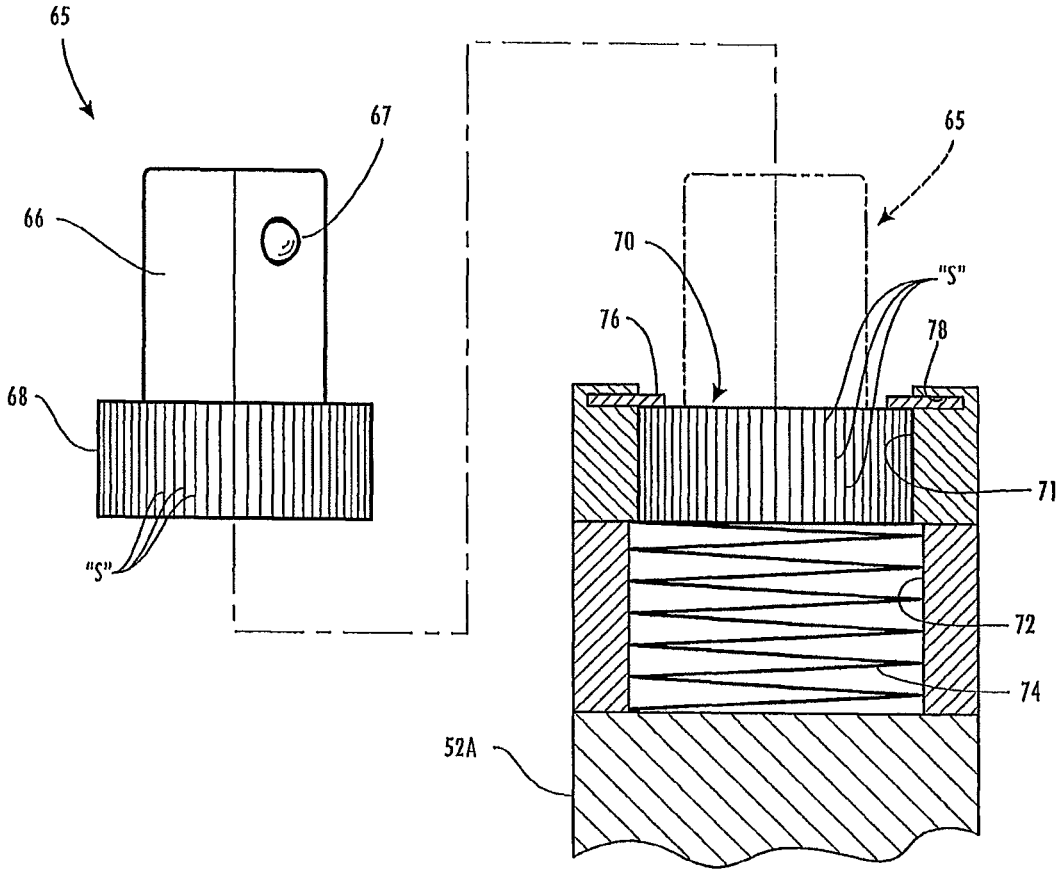
FIG. 16 is an exploded view of a connecting end of the exemplary extension link showing the adjustable geometric fitting removed from the sectioned cavity defined by the extension link.
Figure 17:
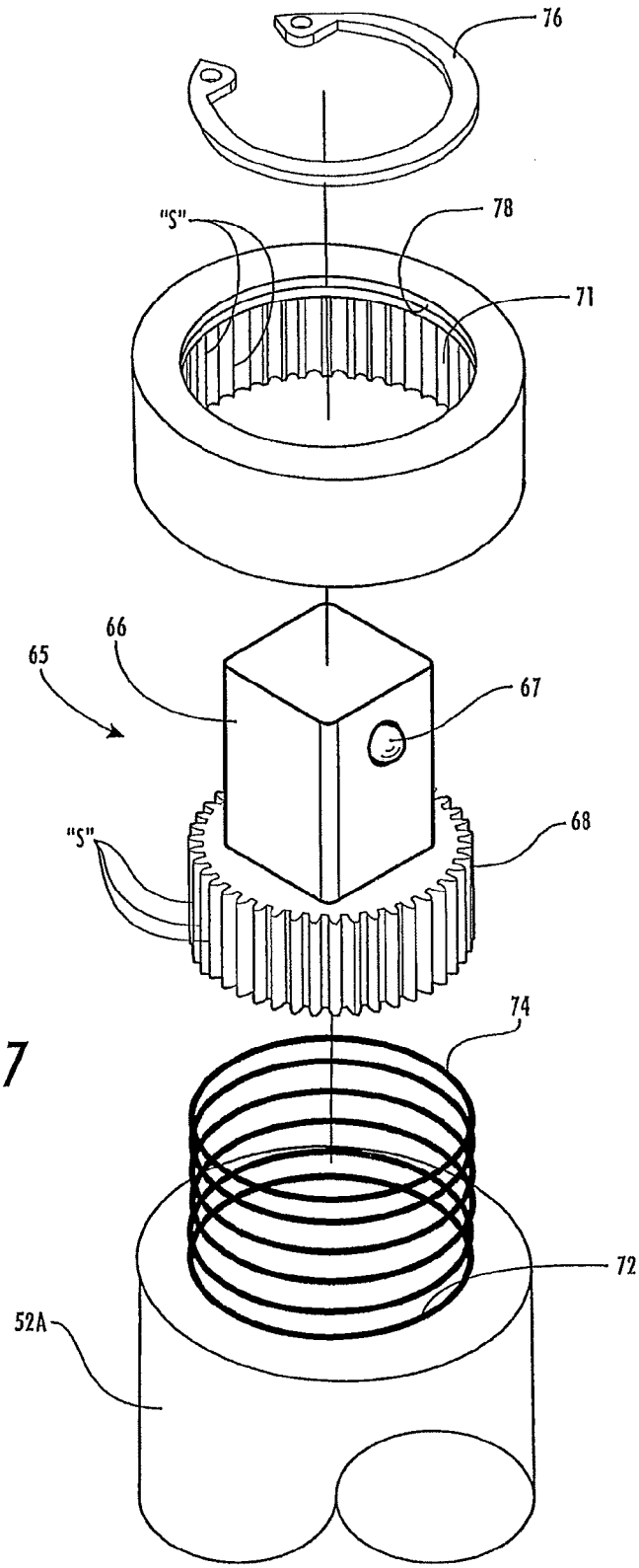
FIG. 17 is a further exploded view of the connecting end of the exemplary extension link.

As best shown in FIGS. 16 and 17, the geometric fitting 65 of the extension link 52A has a substantially square solid head 66 (similar to fitting 58) with one or more spring-loaded ball detents 67, and an externally serrated annular base 68. The geometric fitting 65 is received and retained within a sectioned internal cavity 70 defined by the extension link 52A, and comprising a reduced-diameter internally serrated cavity section 71 and an enlarged-diameter non-serrated cavity section 72. The cavity sections 71, 72 may be formed by independent cylindrical elements which are separately and permanently joined together (e.g., by welding) with the extension link, or which may be integrally formed (e.g., as a single homogenous unit) with the extension link 52A.

A spring 74 (or other biasing means) is located within the non-serrated cavity section 72 of the extension link 52A, and operates to engage and normally urge the externally serrated base 68 of the geometric fitting 65 into the internally serrated cavity section 71. In this "normal" spring-biased position, complementary serrations "S" of the geometric fitting 65 and the sectioned cavity 70 engage (or mate) to operatively lock the geometric fitting 65 against rotation in a selected orientation relative to the body 63 of extension link 52A.

Figure 18A:
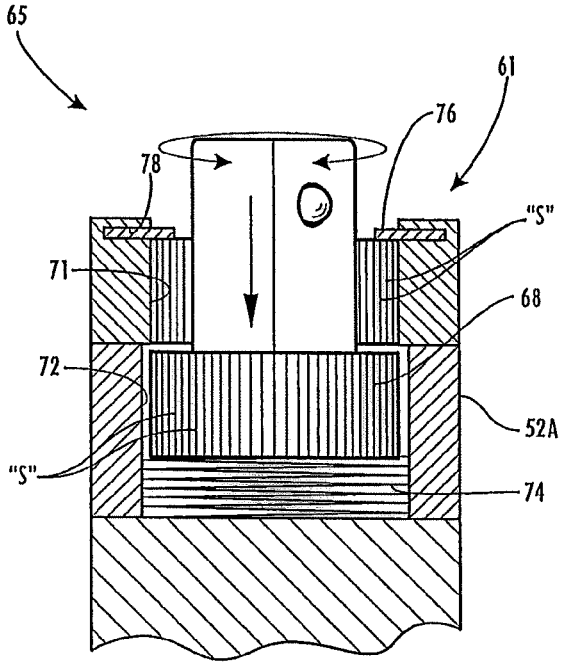
FIGS. 18A and 18B are fragmentary cross-sectional views demonstrating rotatable adjustment of the geometric fitting located at the connecting end of the exemplary extension link.
Figure 18B:
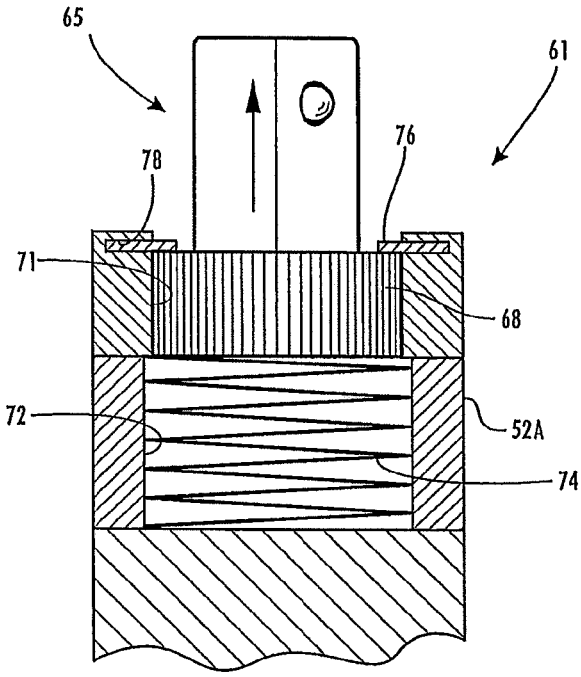

Referring to FIGS. 18A and 18B, by pushing the geometric fitting 65 against the biasing force of the spring 74, the complementary serrations "S" of the externally serrated base 68 and the internally serrated cavity section 71 disengage, and the externally serrated base 68 moves into the enlarged non-serrated cavity section 72, thereby enabling rotational adjustment of the geometric fitting 65 to another selected orientation. When released, the spring 74 returns the geometric fitting 65 to its normally extended and rotatably locked position, shown in FIG. 18B. A resilient, deformable retention ring 76 is located within an annular groove 78 formed with the extension link 52A, and serves to retain the geometric fitting 65 when in its normal extended position.

The exchangeable tool link 53, shown in FIG. 15, is removably coupled to the adjustable geometric fitting 65 of the extension link 52A at its boxed socket end 54. Each selected orientation of the geometric fitting 65 locates the wrench 55 of the tool link 53 at a distinct notional plane of engagement relative to the threaded fastener (such as indicated at "P" in FIGS. 4 and 6).

Figures 19A, 19B, 19C, 19D, 19E, 19F:
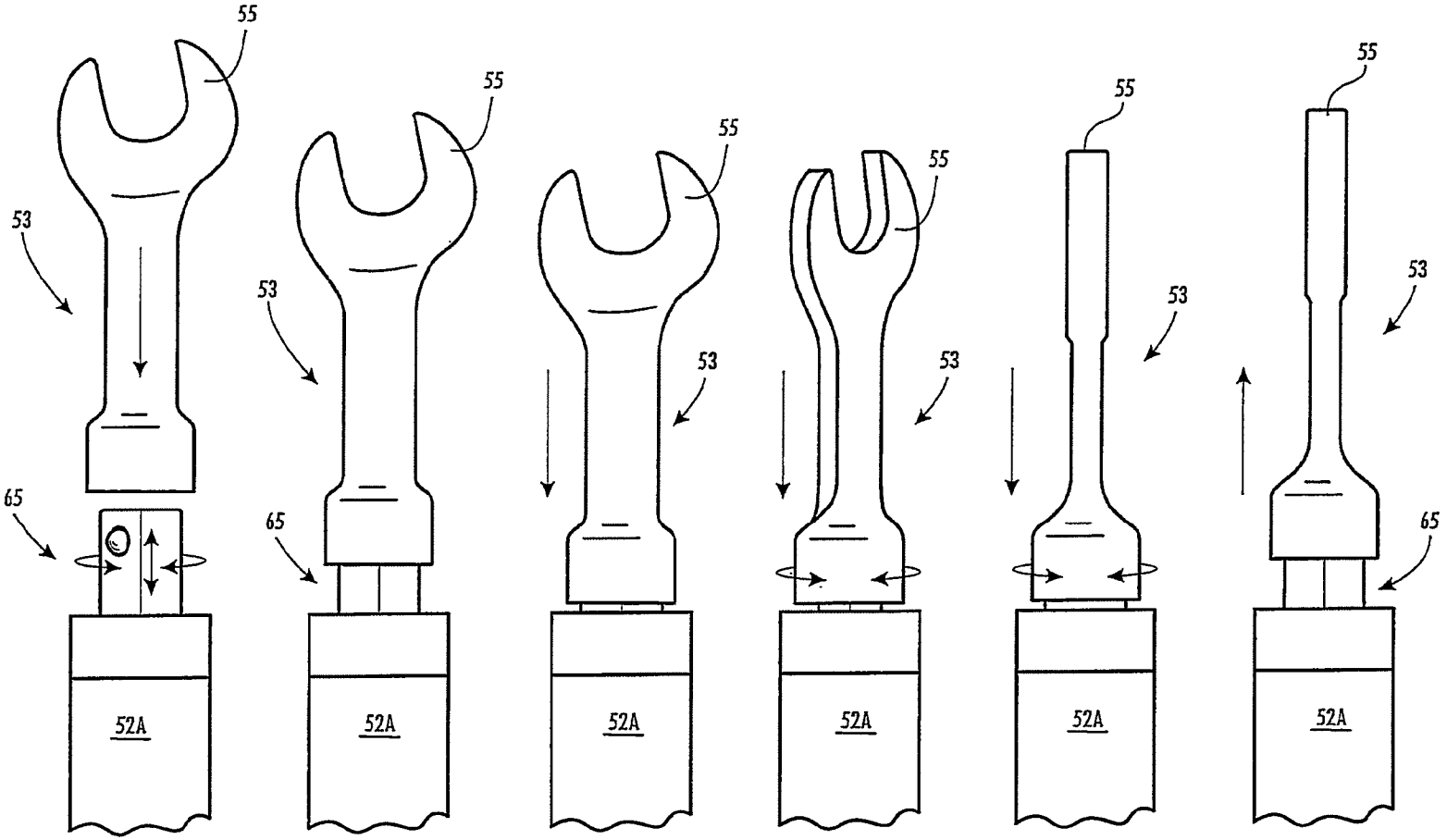
FIGS. 19A-19F are sequential views demonstrating adjustment of the extension link to locate the wrench of the tool link in a selected one of multiple various orientations.
Figure 20:
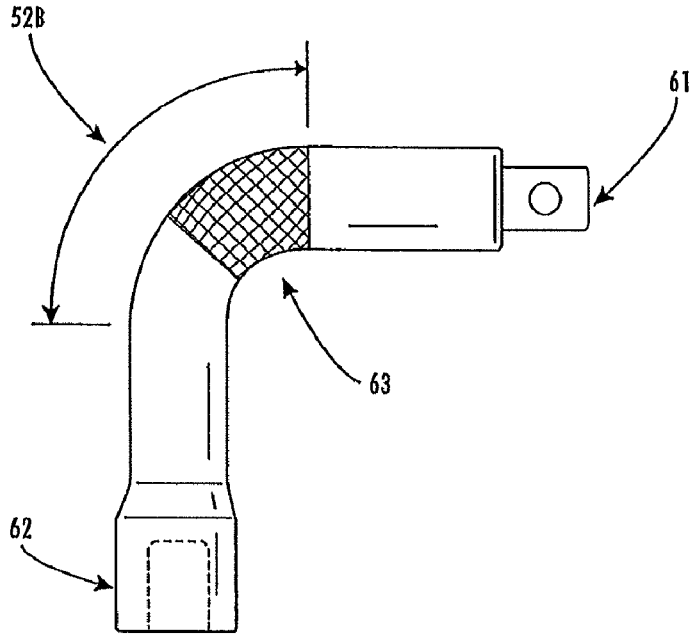
FIGS. 20 and 21 show alternative formations of the exemplary extension link at substantially 90 degrees and 45 degrees, respectively.
Figure 21:
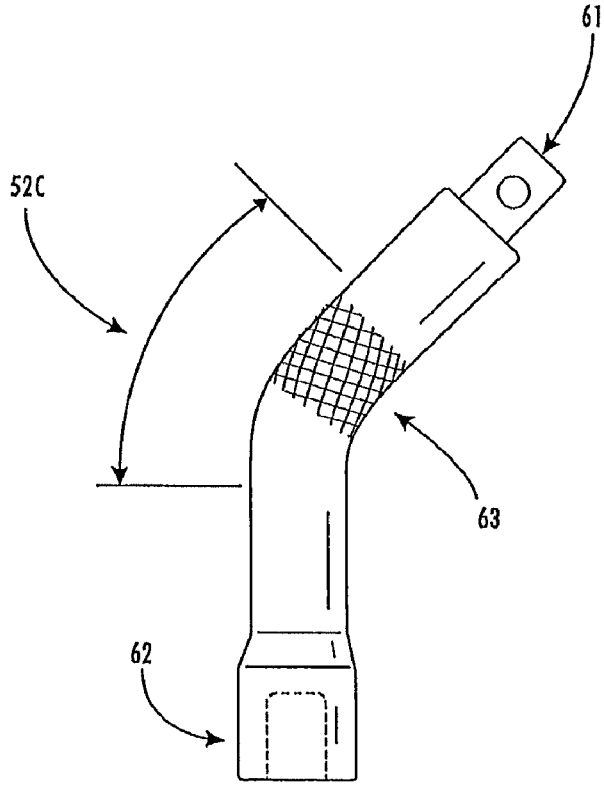

FIGS. 19A-19F sequentially demonstrate an exemplary technique for adjusting the geometric fitting 65 and orientation of the wrench 55. As shown in FIGS. 19A and 19B, the tool link 53 is applied to the connecting end of the extension link 52A to mate the socket 54 and adjustable fitting 65. By pushing the tool link 53 and extension link 52A together (i.e., applying an opposing linear force), as demonstrated in FIG. 18C, the complementary serrations "S" of the externally serrated base 68 and the internally serrated cavity section 71 disengage, as previously described and shown in FIG. 18A. With the externally serrated base 68 moved into (and held within) the enlarged non-serrated cavity section 72 (See FIG. 18A), the user simultaneously rotates the tool link 53 to selectively adjust the orientation of the wrench 55, as demonstrated in FIGS. 19D and 19E. When the desired tool orientation is reached, the linear force applied to the tool link 53 and/or extension link 52A is released and the spring 74 returns the geometric fitting 65 to its normally extended and rotatably locked position, shown in FIG. 18B and demonstrated in FIG. 19F.

Figure 22:
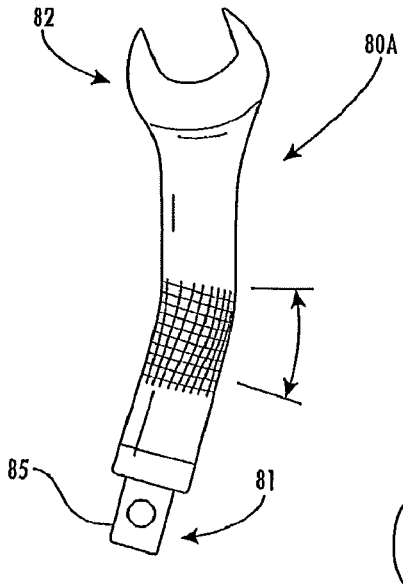
FIGS. 22-24 illustrate exemplary embodiments of an exchangeable tool link incorporating an rotatably adjustable geometric fitting of the present disclosure, and showing the tool link formed at substantially 15 degrees, 45 degrees, and 90 degrees, respectively.
Figure 23:
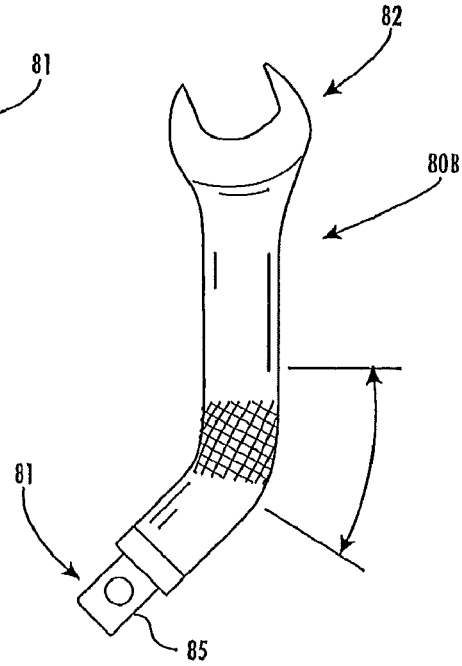
Figure 24:
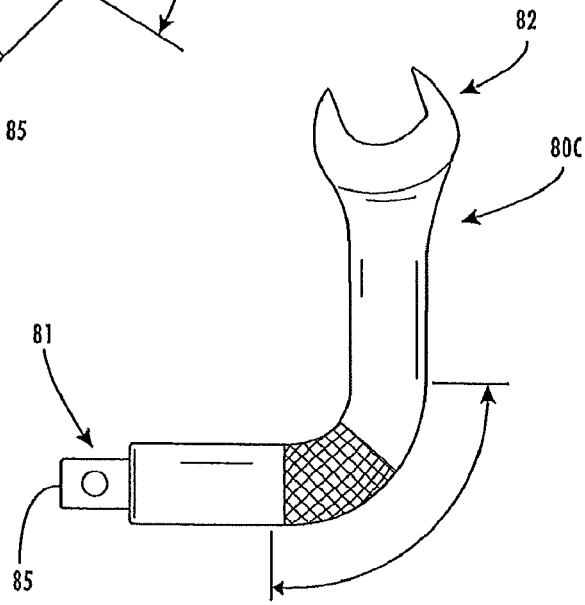

In further alternative embodiments shown in FIGS. 22-24, an exemplary tool assembly may incorporate an exchangeable tool link 80A, 80B, or 80C comprising a proximal connecting end 81 identical to the connecting end 61 of extension link 52A, and an opposing fastener-engaging distal end 82 designed for engaging a threaded fastener. The tool link 80A, 80B, 80C may comprise a rotatably adjustable geometric fitting 85 designed to insert into a complementary shaped socket of a tool handle or extension, and including the exact elements and structural features described above with reference to FIGS. 16 and 17. The exemplary tool link 80A may comprise a body formed at substantially 15 degrees, as shown in FIG. 22; while tool link 80B may comprise a body formed at substantially 45 degrees, as shown in FIG. 23; while tool link 80C may comprise a body formed at substantially 90 degrees, as shown in FIG. 24.

Figure 25:
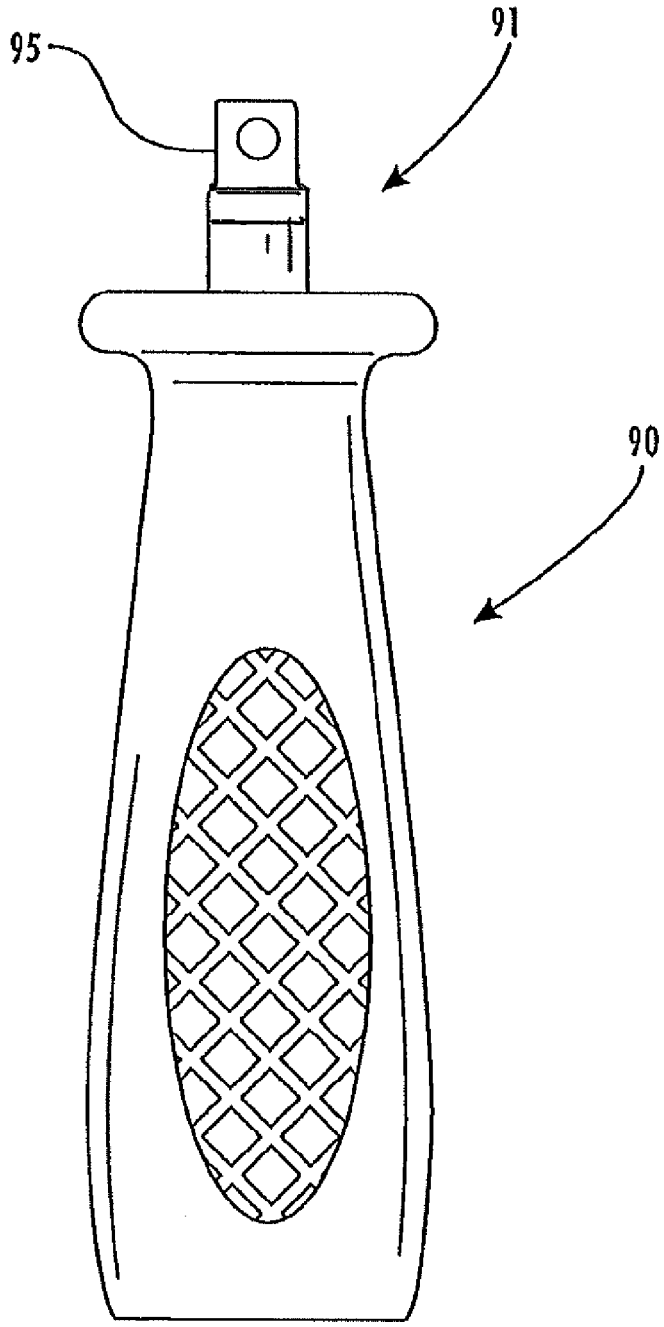
FIG. 25 is an exemplary embodiment of a tool handle incorporating an rotatably adjustable geometric fitting of the present disclosure.

FIG. 25 illustrates a further exemplary handle 90 having a connecting end 91 identical to the connecting end 61 of extension link 52A, discussed above. The handle 90 may comprise a rotatably adjustable geometric fitting 95 designed to insert into a complementary shaped socket of a tool adapter or extension or the like, and including the exact elements and structural features described above with reference to FIGS. 16 and 17.

Exemplary embodiments of the present invention are described above. No element, act, or instruction used in this description should be construed as important, necessary, critical, or essential to the invention unless explicitly described as such. Although only a view of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

I claim:

1. A multiple-link tool assembly, comprising:

an extension link comprising:

(i) a connecting end defining a sectioned cavity comprising a reduced-diameter internally serrated cavity section and an enlarged-diameter non-serrated cavity section;

(ii) an adjustable geometric fitting comprising an externally serrated base received and retained within said sectioned cavity;

(iii) a spring located within the non-serrated cavity section, and adapted for normally urging the externally serrated base of said geometric fitting into the internally serrated cavity section, such that complementary serrations of said geometric fitting and said sectioned cavity engage to operatively lock said geometric fitting in a selected orientation, and upon linear movement of said geometric fitting against a biasing force of said spring the complementary serrations of the externally serrated base and the internally serrated cavity section disengage as the externally serrated base moves into the non-serrated cavity section, thereby enabling rotational adjustment of said geometric fitting to another selected orientation; and a tool link having a proximal end removably joined to the geometric fitting of said extension link and a fastener-engaging distal end adapted for engaging a threaded fastener, whereby each selected orientation of said geometric fitting locates the fastener-engaging distal end of said tool link at a distinct notional plane of engagement relative to the threaded fastener.

2. A multiple-link tool assembly according to claim 1, wherein said extension link comprises a body portion adjacent the connecting end, and formed at an angle selected from a group consisting of substantially 90 degrees, substantially 45 degrees, and substantially 15 degrees.

3. A multiple-link tool assembly according to claim 1, wherein said geometric fitting comprises a solid square head formed with said externally serrated base.

4. A multiple-link tool assembly according to claim 3, wherein the proximal end of said tool link comprises a boxed socket complementary to said geometric fitting of said extension link.

5. A multiple-link tool assembly according to claim 1, wherein the fastener-engaging distal end of said tool link comprises a wrench.

6. A multiple-link tool assembly, comprising:

a tool link comprising:

(i) a fastener-engaging distal end adapted for engaging a threaded fastener, and an opposing proximal end defining a sectioned cavity comprising a reduced-diameter internally serrated cavity section and an enlarged-diameter non-serrated cavity section;

(ii) an adjustable geometric fitting comprising an externally serrated base received and retained within said sectioned cavity;

(iii) a spring located within the non-serrated cavity section, and adapted for normally urging the externally serrated base of said geometric fitting into the internally serrated cavity section, such that complementary serrations of said geometric fitting and said sectioned cavity engage to operatively lock said geometric fitting in a selected orientation relative to said fastener-engaging distal end, and upon linear movement of said geometric fitting against a biasing force of said spring the complementary serrations of the externally serrated base and the internally serrated cavity section disengage as the externally serrated base moves into the non-serrated cavity section, thereby enabling rotational adjustment of said geometric fitting to another selected orientation relative to said fastener-engaging distal end.

7. A multiple-link tool assembly according to claim 6, wherein said tool link comprises a body portion intermediate the distal and proximal ends, and formed at an angle selected from a group consisting of substantially 90 degrees, substantially 45 degrees, and substantially 15 degrees.

8. A multiple-link tool assembly according to claim 6, wherein said geometric fitting comprises a solid square head formed with said externally serrated base.

9. A multiple-link tool assembly according to claim 8, and comprising an elongated handle with a connecting end defining a boxed socket complementary to said geometric fitting of said tool link.

10. A multiple-link tool assembly according to claim 6, wherein the fastener-engaging distal end of said tool link comprises a wrench.

11. A tool link for a multiple-link tool assembly, said tool link comprising:

a fastener-engaging distal end adapted for engaging a threaded fastener, and an opposing proximal end, said proximal end defining a sectioned cavity comprising a reduced-diameter internally serrated cavity section and an enlarged-diameter non-serrated cavity section;

an adjustable geometric fitting comprising an externally serrated base received and retained within said sectioned cavity;

a spring located within the non-serrated cavity section, and adapted for normally urging the externally serrated base of said geometric fitting into the internally serrated cavity section, such that complementary serrations of said geometric fitting and said sectioned cavity engage to operatively lock said geometric fitting in a selected orientation relative to said fastener-engaging distal end, and upon linear movement of said geometric fitting against a biasing force of said spring the complementary serrations of the externally serrated base and the internally serrated cavity section disengage as the externally serrated base moves into the non-serrated cavity section, thereby enabling rotational adjustment of said geometric fitting to another selected orientation relative to said fastener-engaging distal end.

12. A tool link according to claim 11, and comprising a body portion intermediate said distal and proximal ends, and formed at an angle selected from a group consisting of substantially 90 degrees, substantially 45 degrees, and substantially 15 degrees.

13. A tool link according to claim 11, wherein said geometric fitting comprises a solid square head formed with said externally serrated base.

14. A tool link according to claim 13, and comprising an elongated handle with a connecting end defining a boxed socket complementary to said geometric fitting of said tool link.

15. A tool link according to claim 11, wherein the fastener-engaging distal end comprises a wrench.

16. An extension link for a multiple-link tool assembly, said extension link comprising:

a connecting end defining a sectioned cavity comprising a reduced-diameter internally serrated cavity section and an enlarged-diameter non-serrated cavity section;

an adjustable solid geometric fitting comprising an externally serrated base received and retained within said sectioned cavity;

a spring located within the non-serrated cavity section, and adapted for normally urging the externally serrated base of said geometric fitting into the internally serrated cavity section, such that complementary serrations of said geometric fitting and said sectioned cavity engage to operatively lock said geometric fitting in a selected orientation, and upon linear movement of said geometric fitting against a biasing force of said spring the complementary serrations of the externally serrated base and the internally serrated cavity section disengage as the externally serrated base moves into the non-serrated cavity section, thereby enabling rotational adjustment of said geometric fitting to another selected orientation.

17. An extension link according to claim 16, and comprising a body portion adjacent the connecting end, and formed at an angle selected from a group consisting of substantially 90 degrees, substantially 45 degrees, and substantially 15 degrees.

18. An extension link according to claim 16, wherein said geometric fitting comprises a solid square head formed with said externally serrated base.

19. An extension link according to claim 18, wherein the proximal end of said tool link comprises a boxed socket complementary to said geometric fitting of said extension link.

20. An extension link according to claim 16, wherein the fastener-engaging distal end of said tool link comprises a wrench.

* * * * *